US010941514B2

(12) United States Patent
Oak et al.

(10) Patent No.: US 10,941,514 B2
(45) Date of Patent: Mar. 9, 2021

(54) DRYING APPARATUS AND LAUNDRY DRYING MACHINE INCLUDING THE SAME

(71) Applicant: SAMSUNG ELECTRONICS CO., LTD., Suwon-si (KR)

(72) Inventors: Seong-Min Oak, Hwaseong-si (KR); Jung Sang Choi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 228 days.

(21) Appl. No.: 16/061,168

(22) PCT Filed: Nov. 23, 2016

(86) PCT No.: PCT/KR2016/013534
§ 371 (c)(1),
(2) Date: Jun. 11, 2018

(87) PCT Pub. No.: WO2017/099393
PCT Pub. Date: Jun. 15, 2017

(65) Prior Publication Data

US 2018/0355548 A1 Dec. 13, 2018

(30) Foreign Application Priority Data

Dec. 11, 2015 (KR) ..... 10-2015-0176674

(51) Int. Cl.
*D06F 58/24* (2006.01)
*F26B 25/06* (2006.01)
(Continued)

(52) U.S. Cl.
CPC ..... *D06F 58/24* (2013.01); *D06F 18/00* (2013.01); *D06F 58/02* (2013.01); *D06F 58/26* (2013.01);
(Continued)

(58) Field of Classification Search
CPC ..... D06F 58/24; D06F 18/00; A47L 15/483; A47L 15/488; A47L 15/486;
(Continued)

(56) References Cited

U.S. PATENT DOCUMENTS

2005/0016010 A1* 1/2005 Pyo ..... D06F 58/24 34/62
2012/0227279 A1* 9/2012 Dewald, III ..... D06F 58/24 34/467
2013/0008049 A1* 1/2013 Patil ..... F26B 21/086 34/469

FOREIGN PATENT DOCUMENTS

CN 1403649 3/2003
CN 103403243 11/2013
(Continued)

OTHER PUBLICATIONS

International Search Report dated Mar. 17, 2017 from International Patent Application No. PCT/KR2016/013534, 5 pages.
(Continued)

*Primary Examiner* — Jason Lau
(74) *Attorney, Agent, or Firm* — Staas & Halsey LLP

(57) ABSTRACT

A drying apparatus according to the present invention and a laundry drying machine including the same circulate only some of humid air introduced from a drum and discharge the remaining humid air through a discharge port, and then introduce mixed air, in which external air introduced through an introduction port and circulated humid air are mixed, into the drying duct to supply the air to the drum. Accordingly, since air in which there is little moisture may be circulated, drying performance of the drying apparatus may be improved.
Further, by disposing an introduction fan or a discharge fan adjacent to the discharge port and mixing the humid air with the external air, since the air of which the moisture amount
(Continued)

is little may be discharged to the outside of a cabinet, or the air discharged through the discharge port may be quickly discharged to the outside of the cabinet by the discharge fan, occurrence of dew condensation in the cabinet may be prevented.

14 Claims, 15 Drawing Sheets

(51) Int. Cl.

| | |
|---|---|
| ***F26B 21/00*** | (2006.01) |
| ***F26B 3/02*** | (2006.01) |
| ***D06F 58/02*** | (2006.01) |
| ***D06F 18/00*** | (2006.01) |
| ***D06F 58/26*** | (2006.01) |
| *D06F 58/20* | (2006.01) |
| *D06F 25/00* | (2006.01) |

(52) U.S. Cl.
CPC ..... *F26B 3/02* (2013.01); *F26B 21/00* (2013.01); *F26B 21/001* (2013.01); *F26B 25/06* (2013.01); *D06F 25/00* (2013.01); *D06F 58/20* (2013.01)

(58) Field of Classification Search
CPC ..... A47L 15/0034; A47L 2401/04; A47L 2501/10; A47L 2501/11; A47L 2501/12; A47L 15/4257; A47L 2301/08; A47L 2401/10; A47L 2401/19; A47L 2501/30; A47L 15/0047; A47L 15/48; A47L 15/481; A47L 19/00; A47L 2501/05; A47L 2501/20; F26B 5/04; F26B 21/004; F26B 21/06; F26B 21/08; F26B 21/083; F26B 21/086; F26B 25/005; F26B 7/005
See application file for complete search history.

(56) References Cited

FOREIGN PATENT DOCUMENTS

| | | | |
|---|---|---|---|
| DE | 3626887 | A1 | 2/1988 |
| EP | 1 710 339 | A1 | 10/2006 |
| KR | 10-2005-0061741 | | 6/2005 |
| KR | 10-2005-0114774 | | 12/2005 |
| KR | 10-2006-0077319 | | 7/2006 |
| KR | 10-0648169 | | 11/2006 |
| KR | 10-2012-0073582 | | 7/2012 |

OTHER PUBLICATIONS

Written Opinion of the International Searching Authority dated Mar. 17, 2017 from International Patent Application No. PCT/KR2016/013534, 6.
Extended European Search Report dated Nov. 22, 2018 in corresponding European Patent Application No. 16873259.2.
European Office Action dated Jul. 15, 2019 from European Patent Application No. 16873259.2, 4 pages.
Chinese Office Action dated Mar. 30, 2020 from Chinese Patent Application No. 201680072600.6, 22 pages.
Chinese Office Action dated Oct. 16, 2020 from Chinese Application No. 201680072600.6, 17 pages.

* cited by examiner

【Fig. 1】
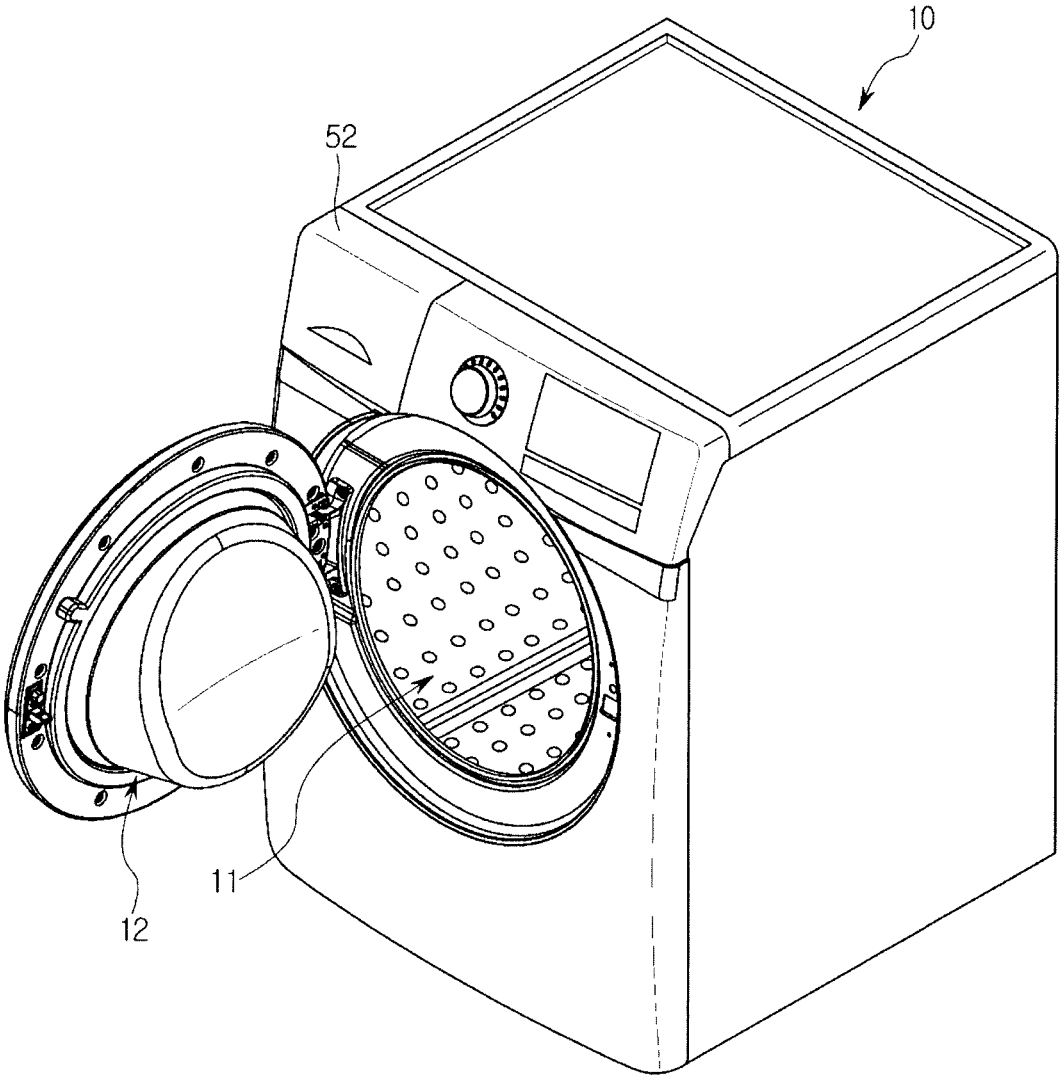

【Fig. 2】
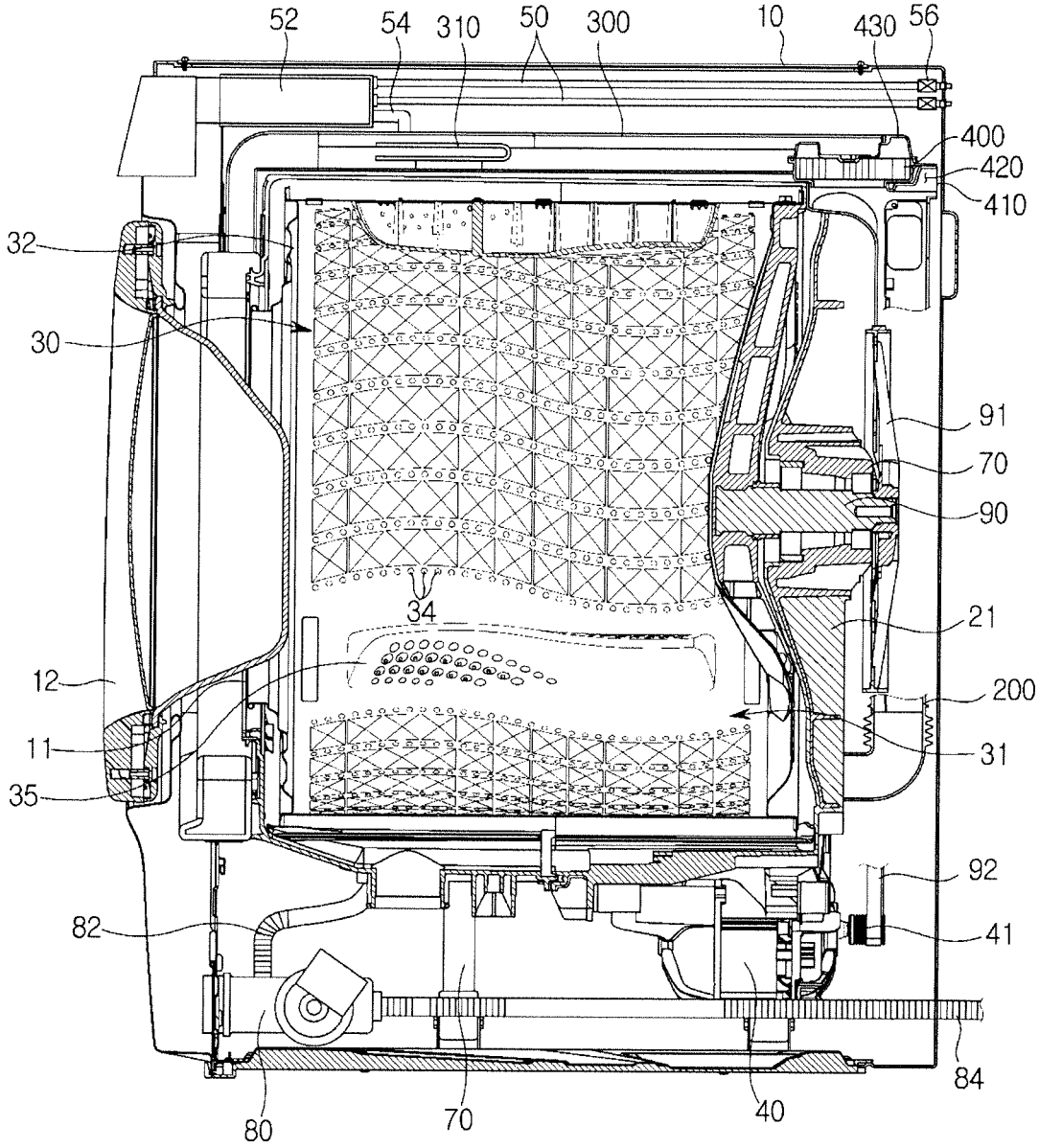

【Fig. 3】
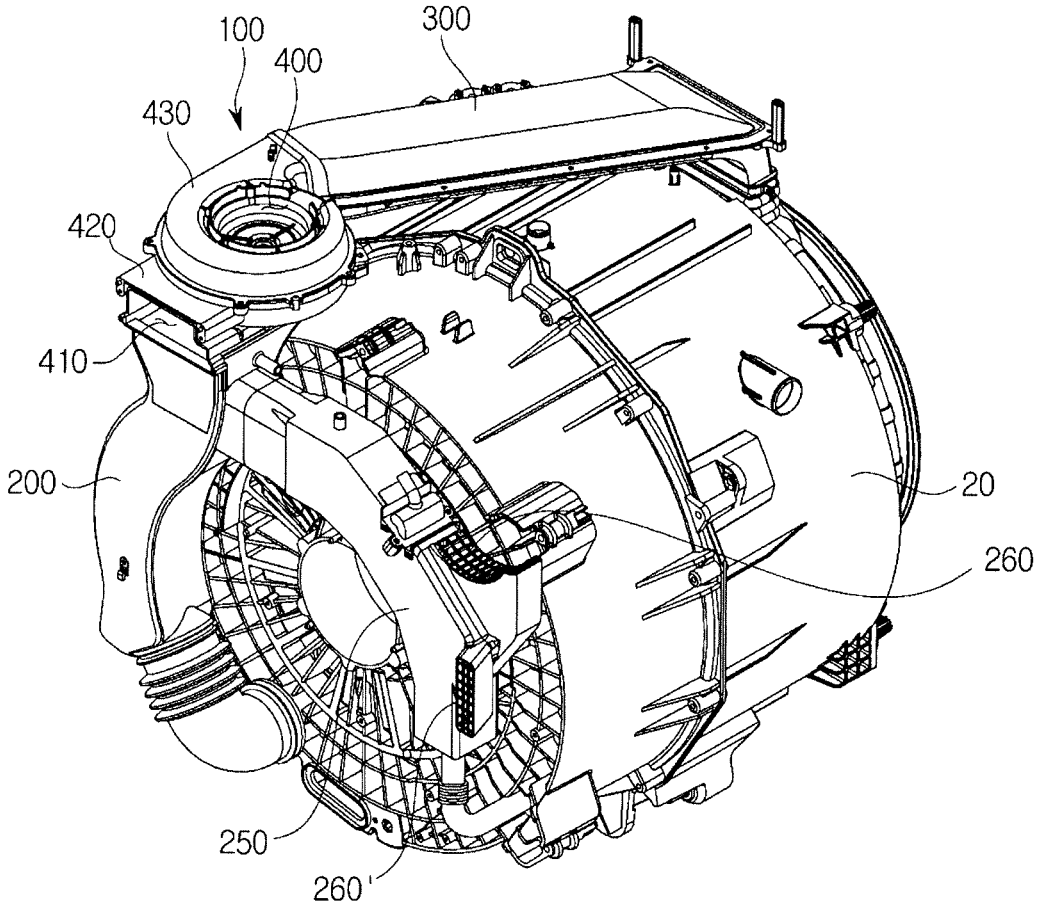

【Fig. 4】
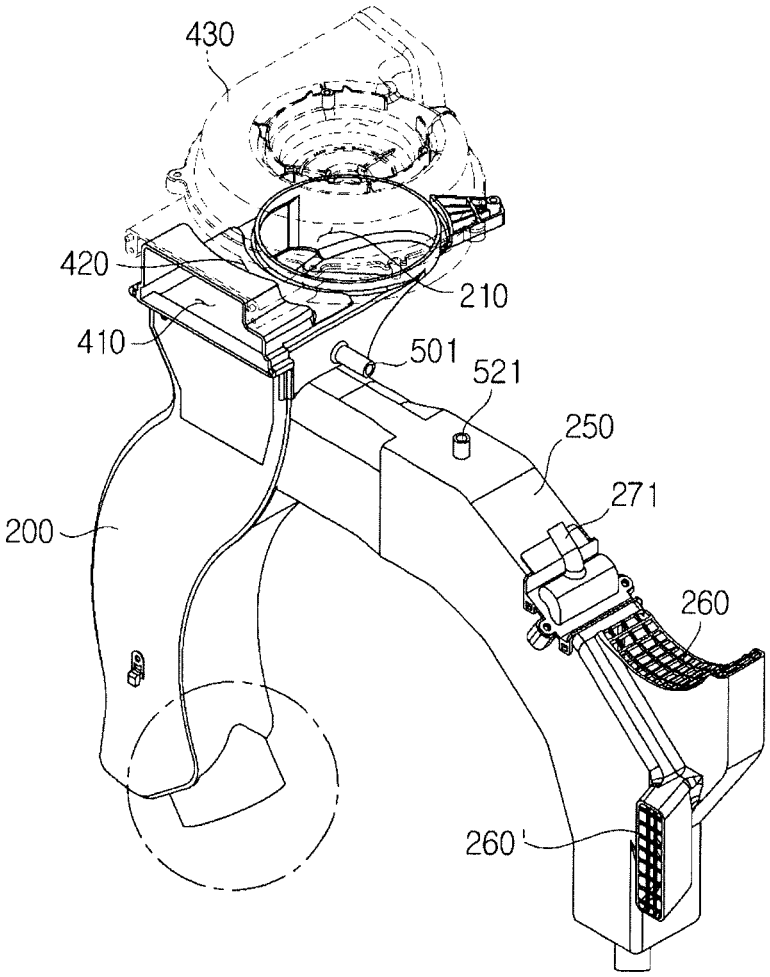

【Fig. 5】
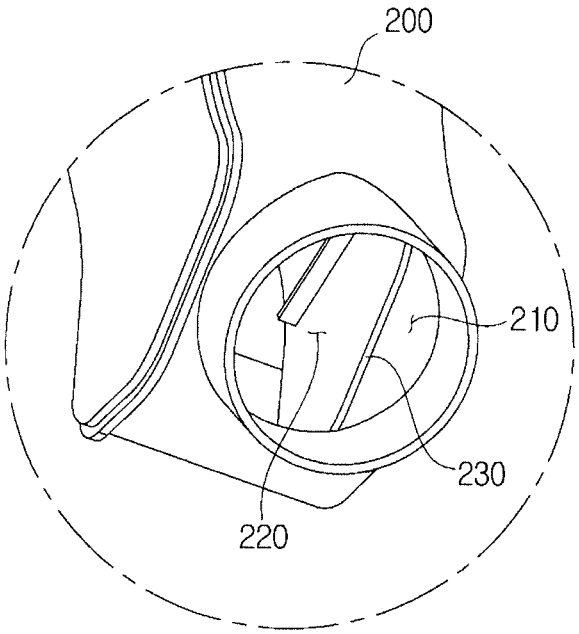

【Fig. 6】
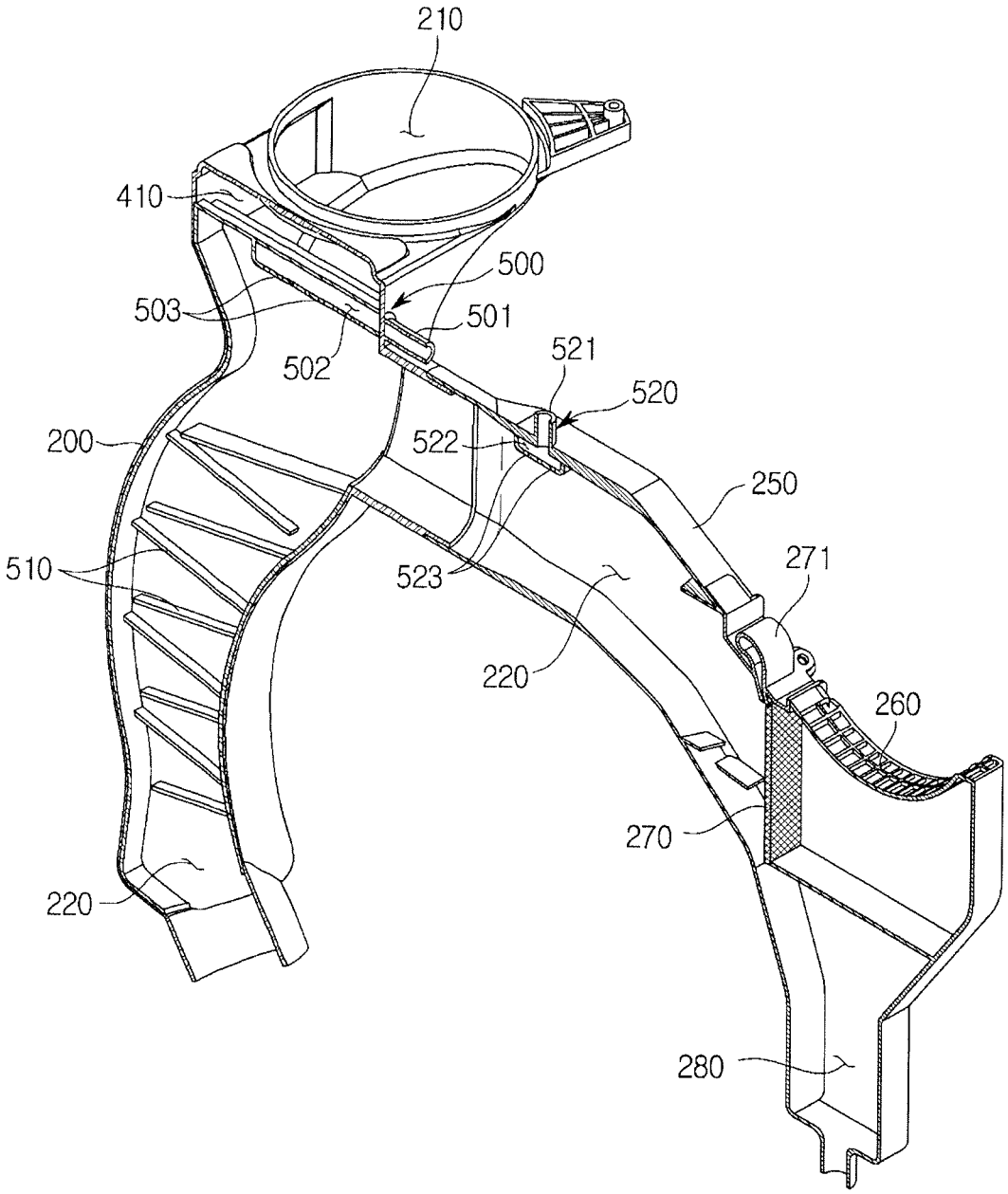

【Fig. 7】
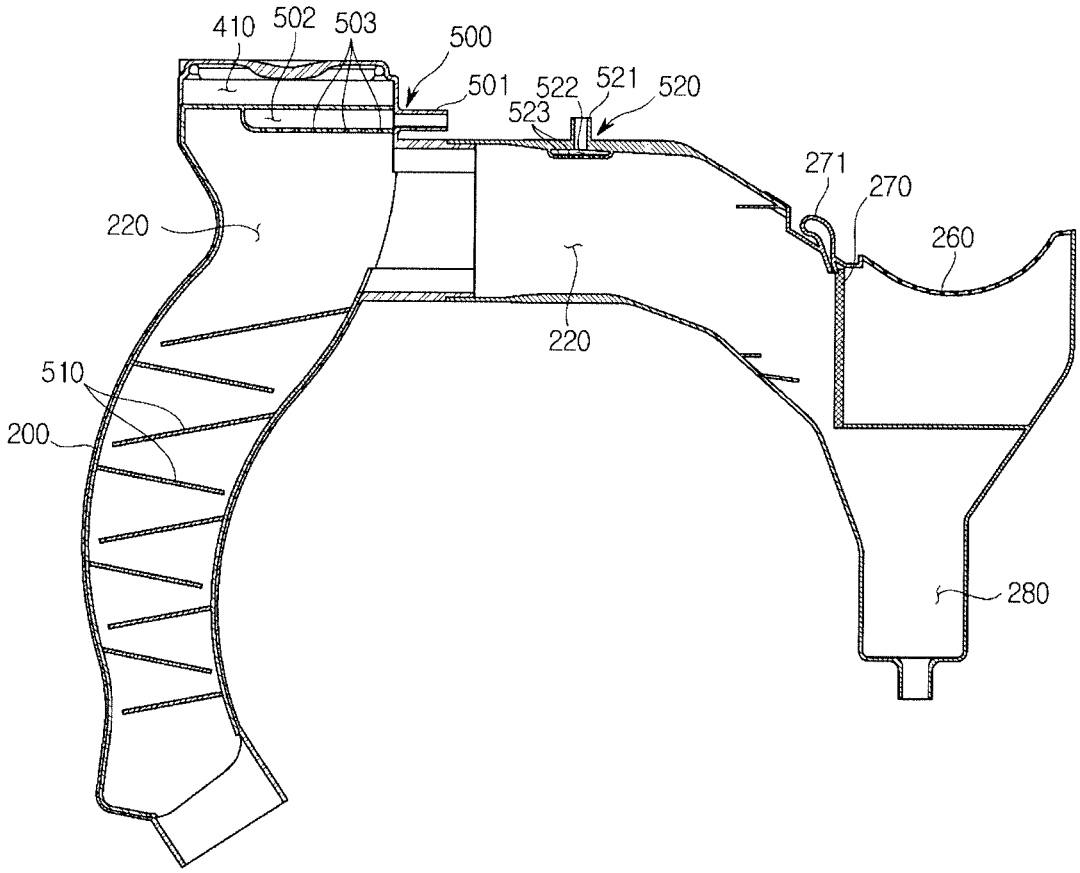

【Fig. 8】
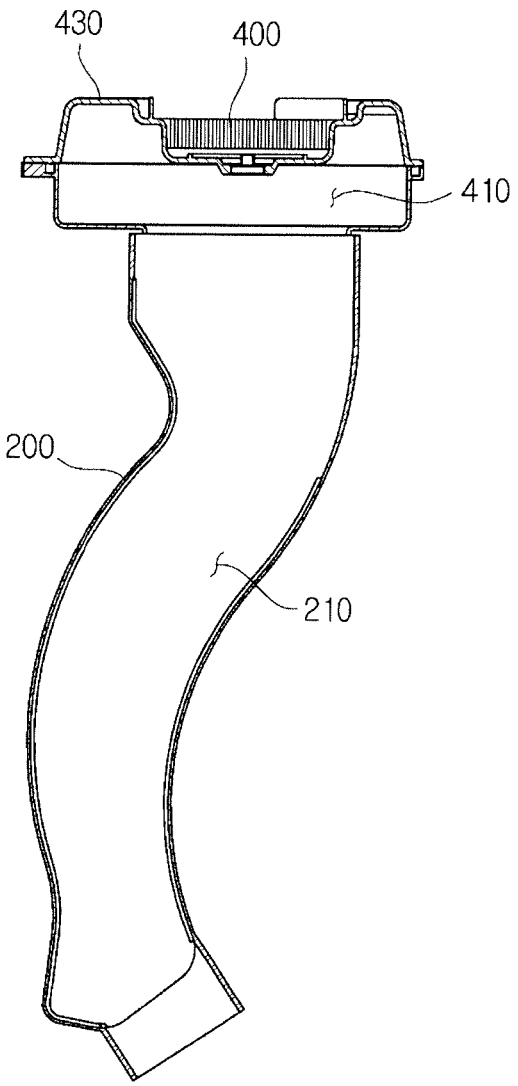

【Fig. 9】
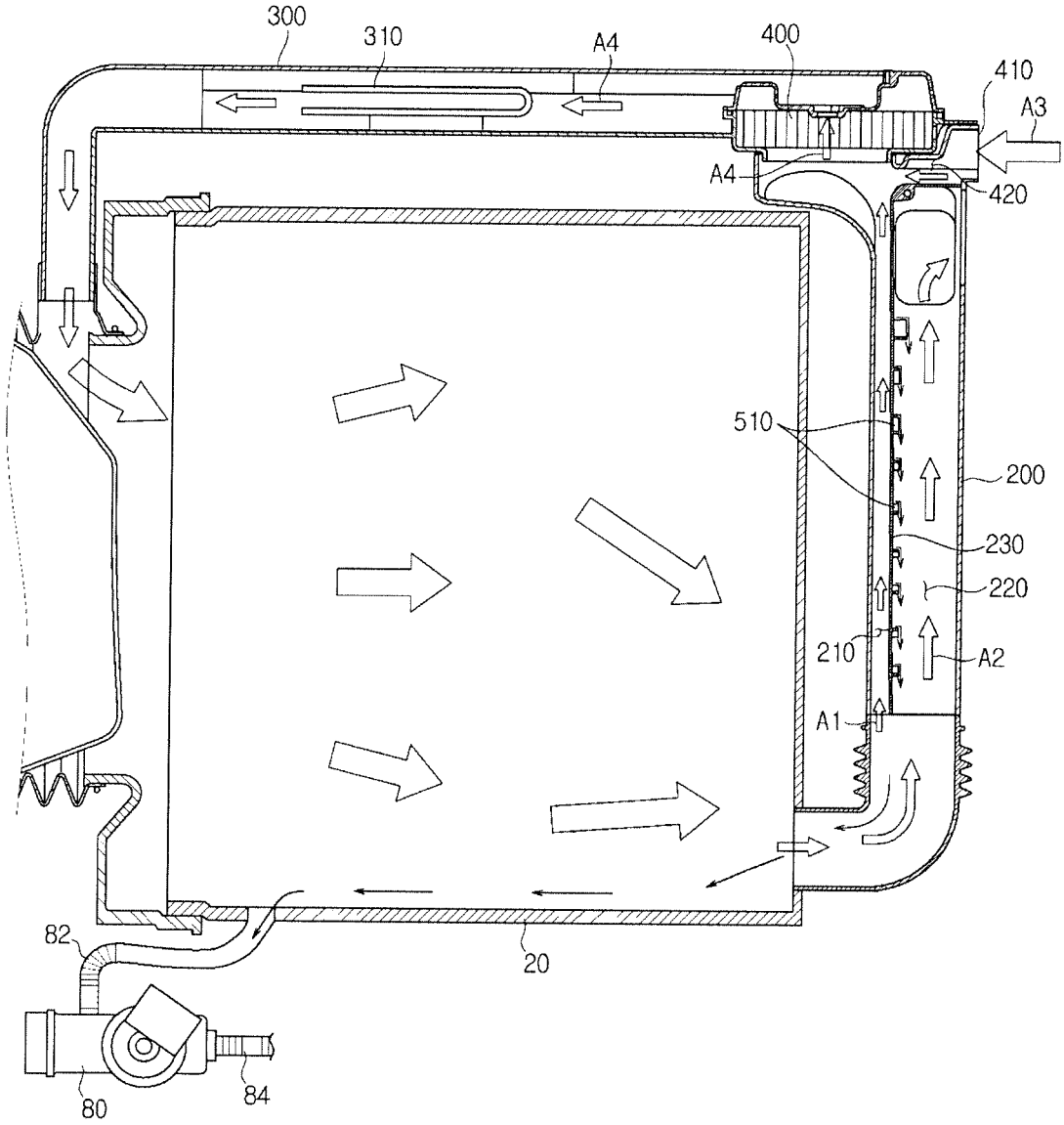

【Fig. 10】
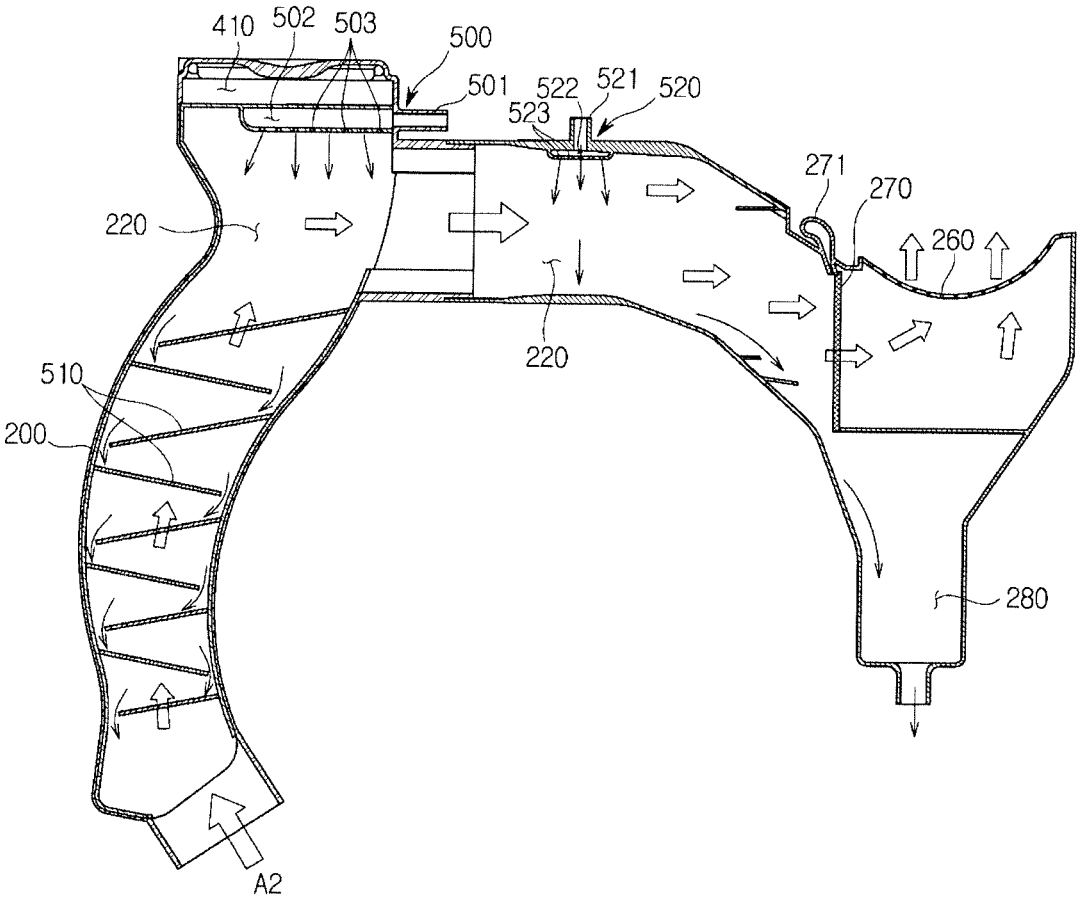

【Fig. 11】
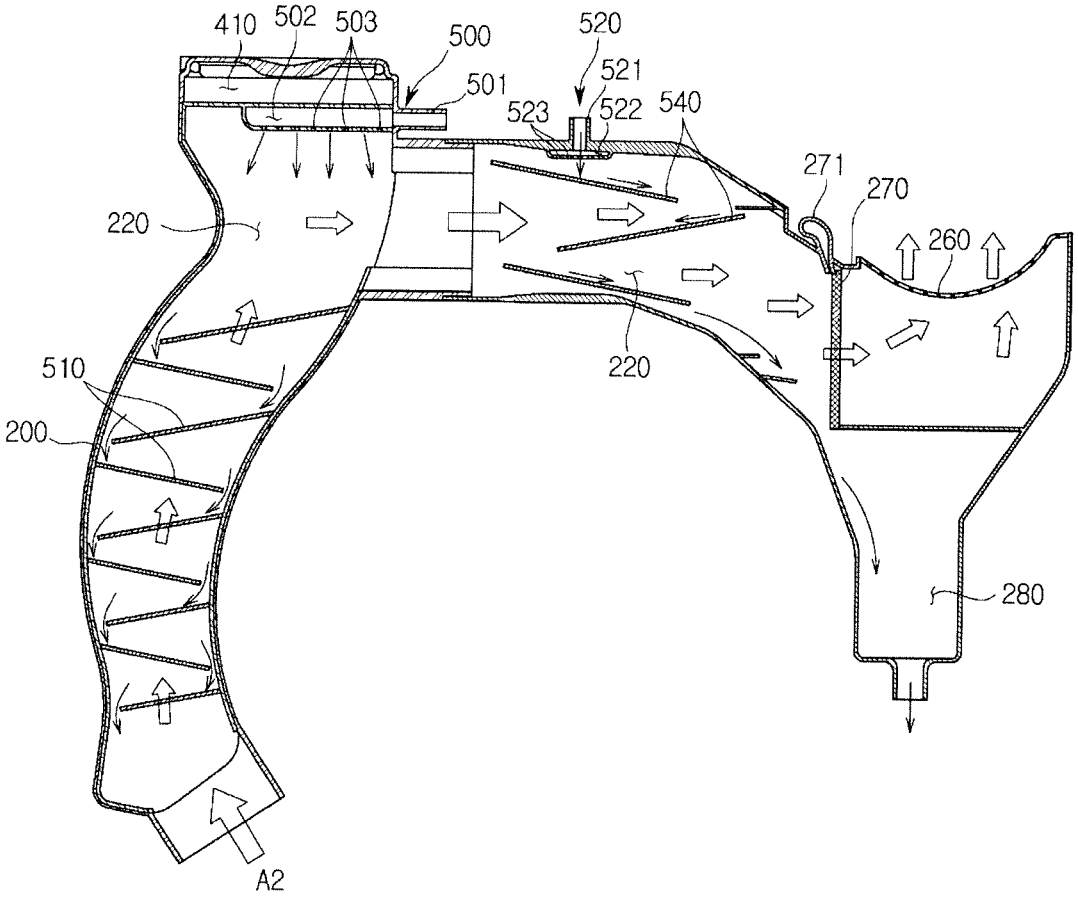

【Fig. 12】
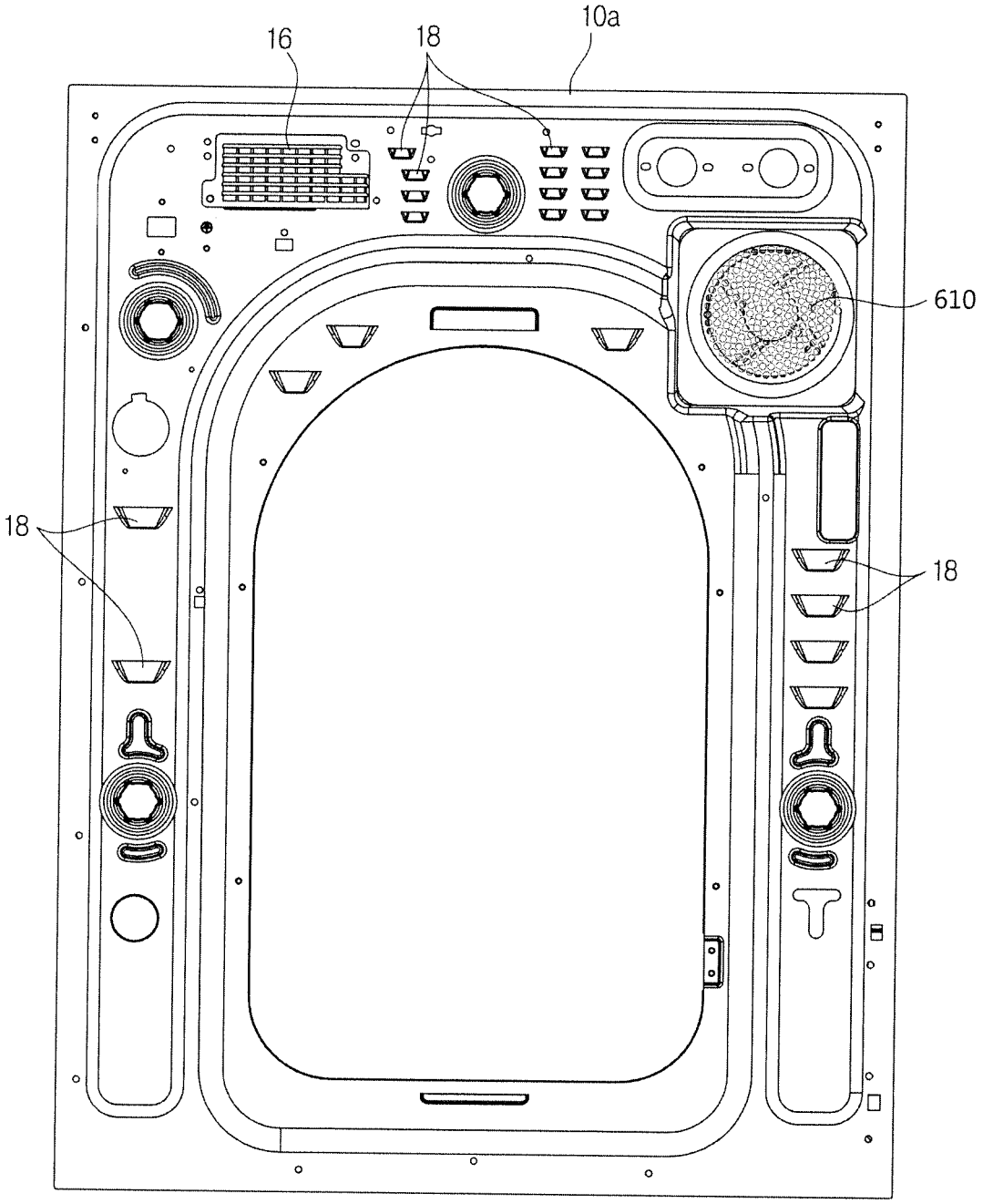

【Fig. 13】
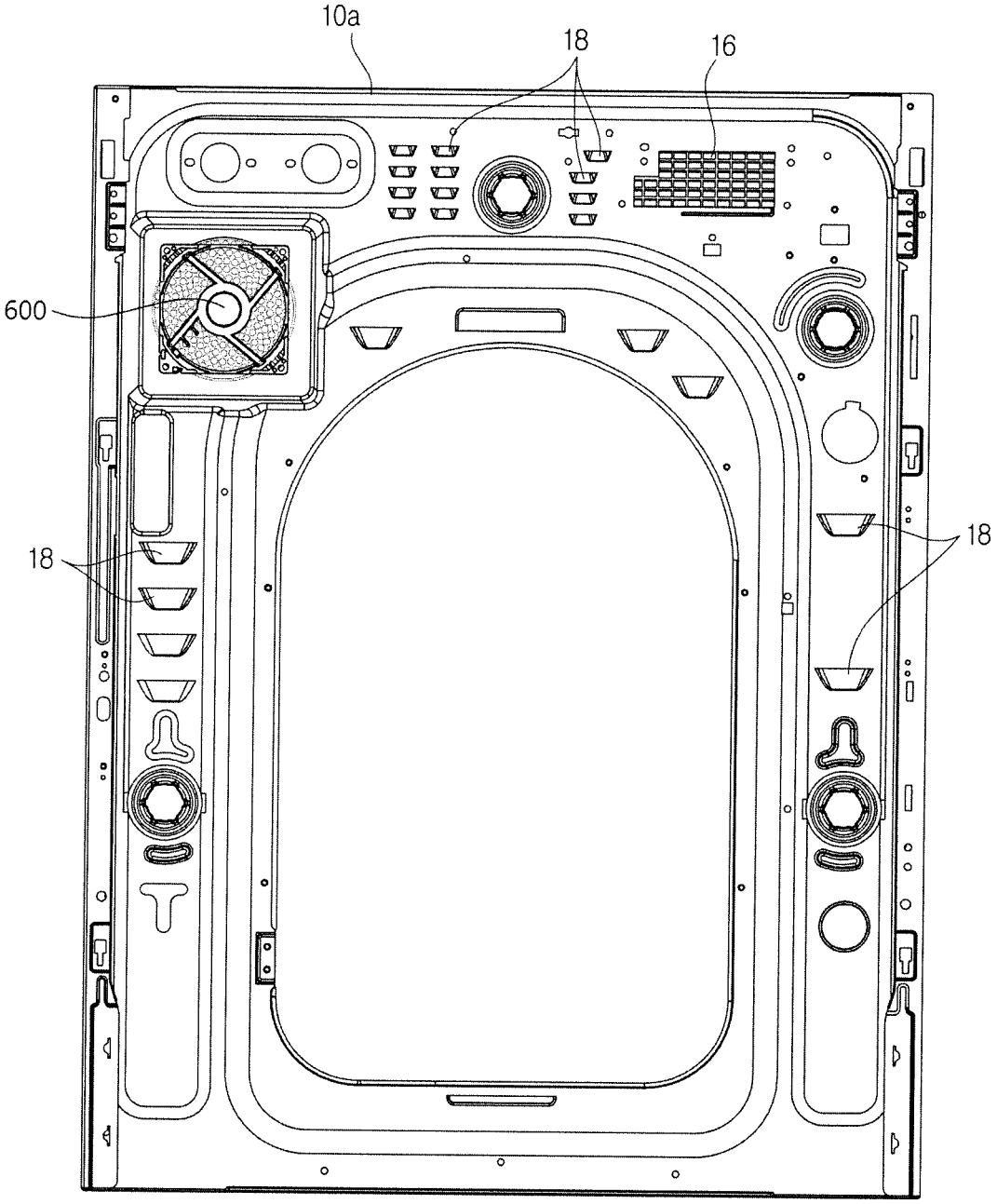

【Fig. 14】
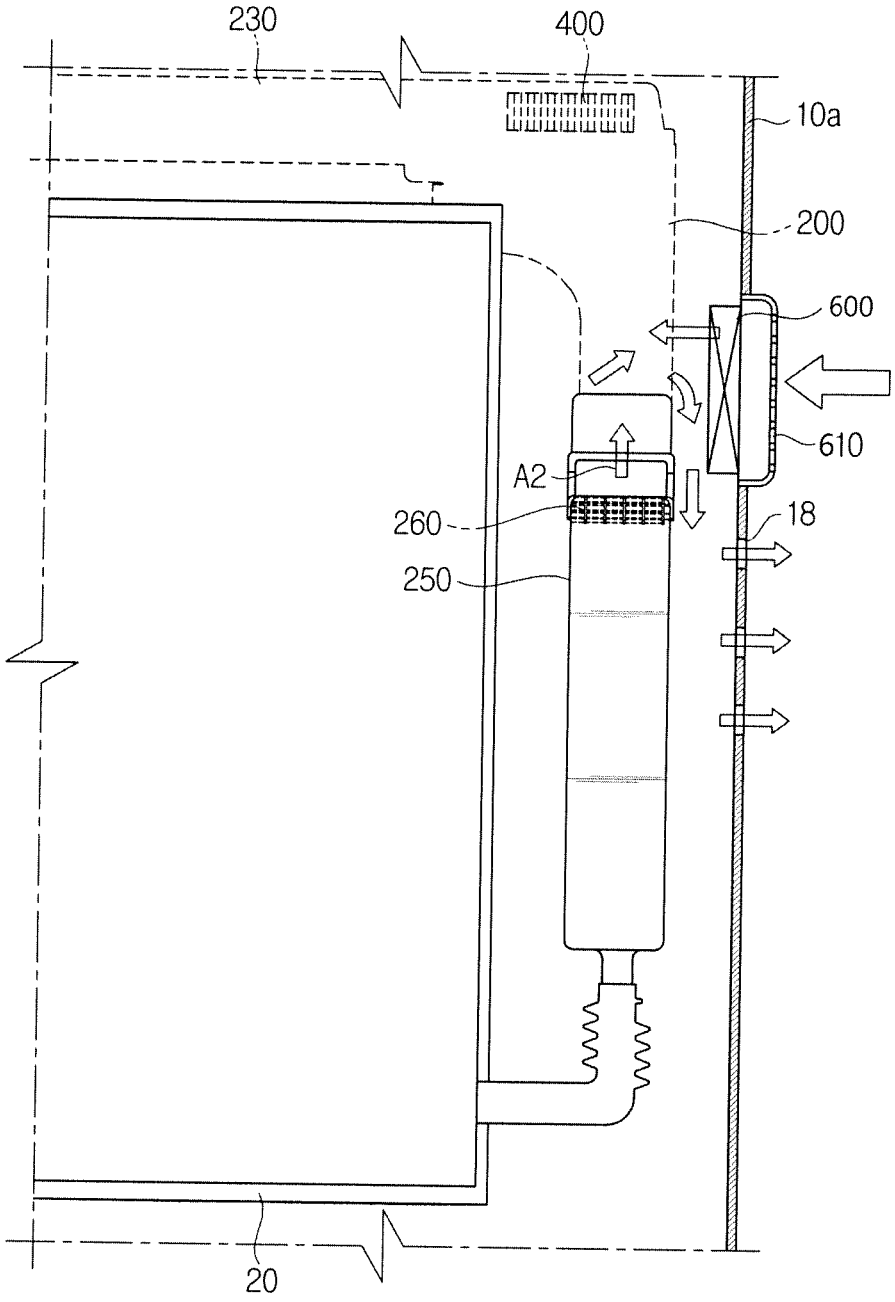

【Fig. 15】
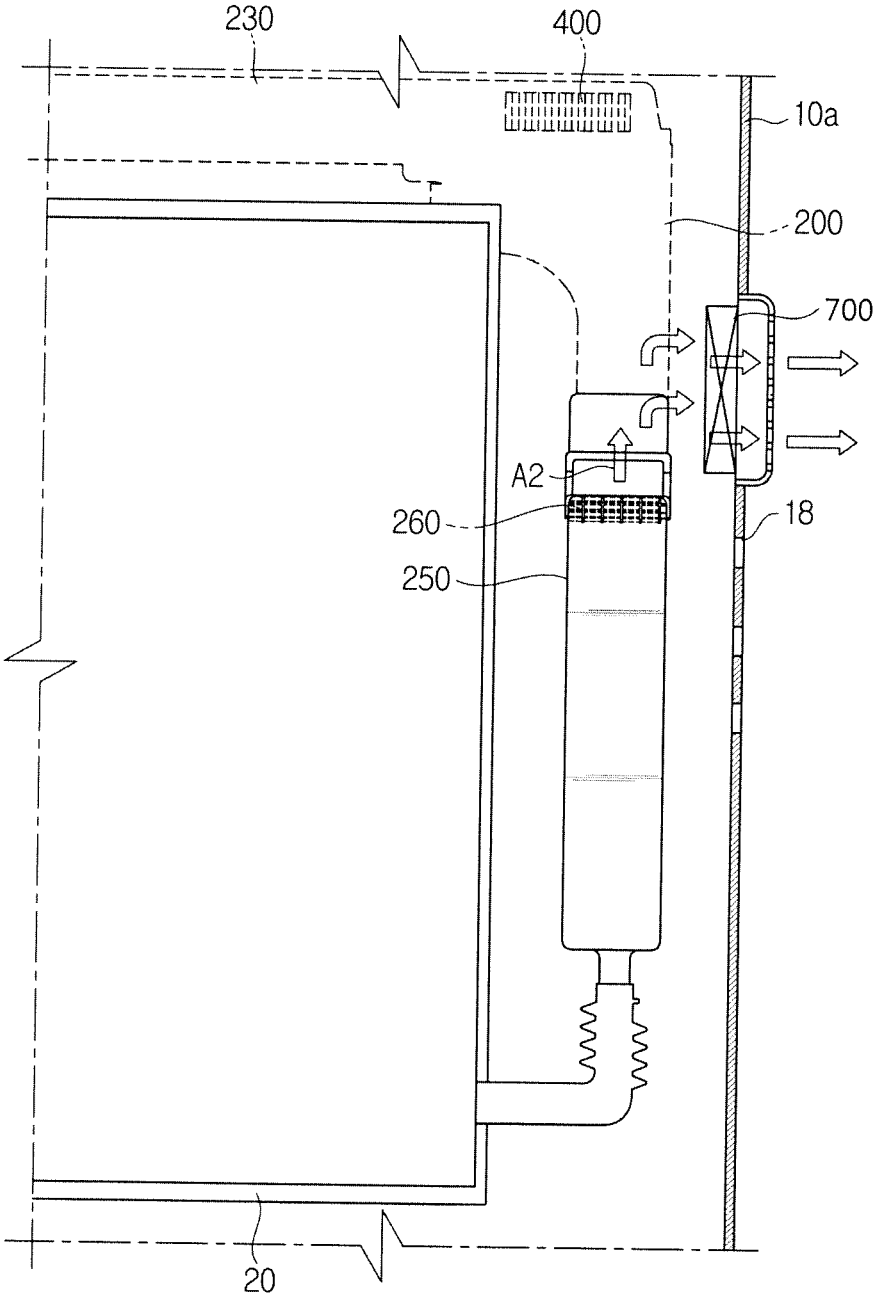

DRYING APPARATUS AND LAUNDRY DRYING MACHINE INCLUDING THE SAME

CROSS-REFERENCE TO RELATED APPLICATIONS

This application is a National Phase Application under 35 U.S.C. § 371 of PCT International Patent Application No. PCT/KR2016/013534, filed Nov. 23, 2016 which claims the foreign priority benefit under 35 U.S.C. § 119 to Korean Patent Application No. 10-2015-0176674 filed Dec. 11, 2015, the contents of which are incorporated herein by reference.

TECHNICAL FIELD

The present invention relates to a laundry drying machine, and more particularly, to a drying apparatus of the laundry drying machine.

BACKGROUND ART

Generally, a laundry drying machine is an apparatus configured to perform washing, rinsing, dehydration, and drying processes to wash laundry.

Laundry drying machines are classified into pulsator type laundry drying machines in which a flow of water generated as rotating blades with small blades attached thereto rotate in a lower portion of a washing tub imparts a force on laundry to wash the laundry, agitator type laundry drying machines in which a rotational direction of large stirring blades with blades attached thereto at a center of a washing tub is regularly reversed to generate a flow of water so as to wash laundry, and drum type laundry drying machines in which laundry is put in a drum and washed by the detergency of a detergent and a force generated by rising and falling of the laundry as the drum rotates.

A drum type laundry drying machine includes a cabinet, a tub installed inside the cabinet and configured to accommodate washing water, a drum rotatably installed inside the tub and configured to accommodate laundry, a driving device configured to rotate the drum, a water supply device configured to supply the washing water to the tub, a drain device configured to drain the washing water to the outside of the cabinet from the drum when washing is completed, and a drying apparatus configured to dry the laundry after a cleaning process is completed.

Generally, a drying apparatus of a laundry drying machine heats laundry to evaporate moisture of the laundry by supplying hot air heated by a heating device to the inside of a drum, and performs drying of the laundry by condensing and then draining the evaporated moisture.

The drying apparatus has a heating device and includes a heating duct having one end connected to a discharge port of a blowing fan and another end connected to the inside of the drum to communicate with each other to supply hot air into the drum, and further includes a condensing duct having one end connected to the inside of the drum to communicate therewith and another end connected to a suction port of the blowing fan to condense and then drain the moisture through a process of guiding humid air generated in the drum to the blowing fan.

INVENTION

Technical Problem

One aspect of the present invention provides a laundry drying machine including a drying apparatus configured to smoothly discharge humid air generated in a drum to improve drying energy efficiency.

Another aspect of the present invention provides a laundry drying machine including a drying apparatus configured to sufficiently dry humid air generated in a drum so that air having humidity conditions similar to external air when discharged to the outside is discharged.

Technical Solution

A drying apparatus according to an aspect of the present invention includes a cabinet including an introduction port into which external air is introduced, a drum disposed inside the cabinet and configured to accommodate an object which is to be dried, a condensing duct provided to condense moisture in air introduced from the inside of the drum, and a drying duct connected to the condensing duct, the introduction port, and the drum to heat some of the air introduced from the condensing duct and the external air introduced through the introduction port and supply some of the above-described heated air into the drum.

The condensing duct may include a first path configured to communicate with the drying duct, and a second path provided separately from the first path and configured to communicate with the discharge port.

The condensing duct further may further include a divider disposed between the first path and the second path to divide the first path and the second path.

The condensing duct may be provided in a pipe shape including a hollow, and the first path and the second path may each be provided in spaces in the hollow divided by the divider.

In a cross-sectional area of each of the first path and the second path through which the air passes, the divider may divide the first path and the second path so that the cross-sectional area of the second path may be provided to be greater than or equal to the cross-sectional area of the first path.

A cross-sectional area ratio of the first path to the second path may be 2:8.

The drying apparatus may further include an auxiliary condensing duct configured to connect the condensing duct and the discharge port to guide the air introduced into the discharge port from the condensing duct, and condense the moisture in the air introduced from the condensing duct.

The drying apparatus may further include a blowing fan disposed between the first path and the drying duct to circulate the air in the first path and the drying duct, and configured to introduce the external air introduced through the introduction port into the drying duct.

The condensing duct further may include a condensate water nozzle, configured to introduce condensate water into the condensing duct, to condense the air which passes through the condensing duct, wherein the condensate water nozzle may be disposed at an upper portion of the second path.

The condensate water may not be supplied into the first path.

A plurality of protruding ribs configured to protrude toward the inside of the second path may be provided in the second path so that the condensate water may be diffused.

The auxiliary condensing duct may include an auxiliary condensate water nozzle, configured to introduce the condensate water into the auxiliary condensing duct, to condense the air which passes through the auxiliary condensing duct.

The drying apparatus may further include an introduction fan disposed adjacent to the discharge port to introduce the external air into the discharge port so that the air which passes through the discharge port may be mixed with the external air in the cabinet.

The drying apparatus may further include a discharge fan disposed adjacent to the discharge port to quickly discharge the air which passes through the discharge port to the outside of the cabinet.

The introduction fan is disposed in a rear surface of the cabinet.

A plurality of discharge slits may be provided in the rear surface of the cabinet so that mixed air formed of the external air and the air which passes through the discharge port may be discharged to the outside of the cabinet.

A laundry drying machine according to an aspect of the present invention includes a cabinet, a drum rotatably disposed inside the cabinet, a first condensing duct configured to condense moisture in air introduced from the inside of the drum, a second condensing duct configured to condense some of the air introduced from the first condensing duct and connected to the first condensing duct to discharge the condensed air to the outside of the cabinet, and a drying duct configured to connect the first condensing duct and the drum to heat the air introduced from the first condensing duct and supply the above-described heated air into the drum, wherein the condensing duct includes a first path configured to communicate with the drying duct, and a second path provided separately from the first path and configured to communicate with the second condensing duct.

The first condensing duct may be provided in a pipe shape including a hollow, and the first path and the second path may each be provided in spaces divided by the divider disposed in the hollow.

In a cross-sectional area of each of the first path and the second path through which the air passes, the divider may divide the first path and the second path so that the cross-sectional area of the second path may be provided to be greater than or equal the cross-sectional area of to the first path.

The condensing duct further may include a condensate water nozzle, configured to introduce condensate water into the condensing duct, to condense the air which passes through the condensing duct, wherein the condensate water nozzle may be disposed at an upper portion of the second path.

An introduction port into which external air is introduced into the cabinet may be included in one side of the cabinet, an introduction path configured to introduce the external air introduced through the introduction port into the drying duct may be disposed between the first path and the drying duct, and the drying duct may heat the air introduced from the first path and the air introduced from the introduction port and supply the above-described heated air into the drum.

Some of the air introduced into the first condensing duct may be introduced into the drying duct through the first path, and then may be heated with the external air introduced through the introduction port and supplied into the drum, and the remaining air introduced into the first condensing duct may be introduced into the second drying duct through the second path and discharged to the outside of the cabinet.

A laundry drying machine according to an aspect of the present invention includes a cabinet including an introduction port into which external air is introduced, a drum rotatably disposed inside the cabinet, a condensing duct configured to condense moisture in air introduced from the inside of the drum and including a first path provided so that some of the air which passes through the condensing duct is introduced into the drum again, and a second path second path provided separately from the first path and including a discharge port in one end thereof to discharge the remaining air which passes through the condensing duct to the outside of the cabinet, a drying duct connected to the first path, the introduction port, and the drum to heat the air introduced into the first path and the external air introduced through the introduction port to supply the above-described heated air into the drum, and an introduction fan disposed adjacent to the discharge port to introduce the external air into the cabinet so that the air discharged from the second path is mixed with the external air in the cabinet and discharged to the outside of the cabinet.

Advantageous Effects

A drying apparatus according to an aspect of the present invention and a laundry drying machine including the same can improve energy efficiency, which is necessary to heat air which dries an object to be dried, by discharging at least some of humid air generated in a drum and suctioning external air.

Further, by sufficiently condensing the discharged humid air and mixing the humid air with the external air when discharging the humid air, occurrence of dew condensation in the laundry drying machine due to the humid air can be prevented.

DESCRIPTION OF DRAWINGS

FIG. 1 is a perspective view of a laundry drying machine according to one embodiment of the present invention.

FIG. 2 is a side-sectional view of the laundry drying machine according to one embodiment of the present invention.

FIG. 3 is a rear perspective view of some components of the laundry drying machine according to one embodiment of the present invention.

FIG. 4 is a rear perspective view of a condensing duct of the laundry drying machine according to one embodiment of the present invention.

FIG. 5 is an enlarged view illustrating a part of another side of the condensing duct in FIG. 4.

FIG. 6 is a perspective view of the condensing duct, of which a part has been removed so that a second path is shown, of the laundry drying machine according to one embodiment of the present invention.

FIG. 7 is a cross-sectional view of a part, in which the second path is shown, of the condensing duct of the laundry drying machine according to one embodiment of the present invention.

FIG. 8 is a cross-sectional view of a part, in which a first path is shown, of the condensing duct of the laundry drying machine according to one embodiment of the present invention.

FIG. 9 is a schematic side-sectional view illustrating a flow of each of air and condensate water in the laundry drying machine according to one embodiment of the present invention.

FIG. 10 is a schematic rear-sectional view illustrating a flow of each of the air and the condensate water in the second path of the laundry drying machine according to one embodiment of the present invention.

FIG. 11 is a schematic rear-sectional view illustrating a flow of each of air and condensate water in a second path of a laundry drying machine according to another embodiment of the present invention.

FIG. 12 is a rear view of a cabinet according to one embodiment of the present invention.

FIG. 13 is a front view of a rear cabinet according to one embodiment of the present invention.

FIG. 14 is a schematic side-sectional view illustrating a flow of each of air discharged from and external air introduced into the laundry drying machine according to one embodiment of the present invention.

FIG. 15 is a schematic side-sectional view illustrating a flow of each of air discharged from and external air introduced into the laundry drying machine according to another embodiment of the present invention.

MODES OF THE INVENTION

Embodiments described in the specification and configurations shown in the accompanying drawings are merely exemplary examples of the present invention, and various modifications may replace the embodiments and the drawings of the present invention at a time at which the present application is filed.

Further, identical symbols or numbers in the drawings of the present invention denote components or elements configured to perform substantially identical functions.

Further, terms used herein are only for the purpose of describing particular embodiments and are not intended to limit the present invention. The singular form is intended to also include the plural form, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, terms used herein are only for the purpose of describing particular embodiments and are not intended to limit the present invention. The singular form is intended to also include the plural form, unless the context clearly indicates otherwise. It should be further understood that the terms "include," "including," "provide," "providing," "have," and/or "having" specify the presence of stated features, integers, steps, operations, elements, components, and/or groups thereof, but do not preclude the presence or addition of one or more other features, integers, steps, operations, elements, components, and/or groups thereof.

Further, the terms "upper side," "upward direction," "lower side," "downward direction" used herein are related to a vertical direction of a laundry drying machine according to one embodiment of the present invention shown in FIG. 1. That is, in FIG. 1, an upper side of a cabinet refers to the upper side, and a lower side of the cabinet refers to the lower side.

Further, in the case of the terms "frontward direction," "rearward direction," "front surface side," "rear surface side" used herein, a side at which a door of the laundry drying machine in FIG. 1 is disposed refers to the frontward direction and a direction opposite that direction refers to the rearward direction.

Further, when viewed from the front, a left side of the laundry drying machine shown in FIG. 1 refers to a left surface, and a right side thereof refers to a right surface.

Further, a drying apparatus according to an aspect of the present invention may be applied to every machine in which an object to be dried is dried. However in one embodiment of the present invention, the drying apparatus will be described as a laundry drying machine only.

Hereinafter, embodiments according to the present invention will be described in detail with reference to the accompanying drawings.

FIG. 1 is a perspective view of a laundry drying machine according to one embodiment of the present invention, and FIG. 2 is a side-sectional view of the laundry drying machine according to one embodiment of the present invention.

As shown in FIGS. 1 and 2, a laundry drying machine 1 includes a cabinet 10 forming the exterior thereof, a tub 20 disposed inside the cabinet 10, a drum 30 rotatably disposed inside the tub 20, and a driving motor 40 configured to drive the drum 30.

An inlet 11 is formed in a front surface of the cabinet 10 so that laundry may be put inside the drum 30. The inlet 11 is opened and closed by a door 12 installed at the front surface of the cabinet 10.

A water supply pipe 50 configured to supply washing water to the tub 20 is installed above the tub 20. One side of the water supply pipe 50 is connected to a water supply valve 56, and the other side of the water supply pipe 50 is connected to a detergent container 52.

The detergent container 52 is connected to the tub 20 through a connection pipe 54. Water supplied from the water supply pipe 50 is supplied into the tub 20 with detergent via the detergent container 52.

The tub 20 is supported by a damper 70. The damper 70 connects a lower inner surface of the cabinet 10 with an outer surface of the tub 20.

The drum 30 includes a cylindrical portion 31, a front plate 32 disposed at a front of the cylindrical portion 31, and a rear plate 33 disposed at a rear of the cylindrical portion 31. An opening for putting in and taking out laundry is formed in the front plate 32, and a shaft 90 configured to transmit power from the driving motor 40 is connected to the rear plate 33.

A plurality of through holes 34 for circulation of washing water are formed in a circumferential surface of the drum 30, and a plurality of lifters 35 provided so that the laundry rises and falls when the drum 30 is rotated are installed on an inner circumferential surface of the drum 30.

The drum 30 and the driving motor 40 are connected by the shaft 90, and according to the type of connection of the shaft 90 and the driving motor 40, the washing machine 1 may be classified into a direct drive type washing machine in which the shaft 90 is directly connected to the driving motor 40 to rotate the drum 30, or an indirect drive type washing machine in which a pulley is connected between the driving motor 40 and the shaft 90 to drive the drum 30.

The laundry drying machine 1 according to one embodiment of the present invention may be provided as the indirect drive type washing machine, but is not limited thereto, and technical features of the present invention may also be applied to the direct drive type washing machine.

One end of the shaft 90 is connected to the rear plate 33 of the drum 30, and the other end of the shaft 90 extends to the outside of a rear portion 21 of the tub 20. The other end of the shaft 90 may be inserted into a pulley 91 to receive a driving force from the driving motor 40. Further, a motor pulley 41 is provided on a rotary shaft of the driving motor 40. A driving belt 92 is provided between the motor pulley 41 and the pulley 100, and thus the shaft 90 may be driven by the driving belt 92.

The driving motor 40 is disposed on one lower side of the tub 20, and thus the shaft 90 may be driven while the driving belt 92 is rotated clockwise or counterclockwise in a vertical direction of the tub 20.

A bearing housing 70 is installed on the rear portion 21 of the tub 20 to rotatably support the shaft 90. The bearing housing 70 may be formed of an aluminum alloy, and when the tub 20 is injection-molded, the bearing housing 70 may be inserted into the rear portion 21 of the tub 20.

A drain pump 80 configured to drain water in the tub 20 to the outside of the cabinet 10, a connection hose 82 configured to connect the tub 20 with the drain pump 80 to introduce the water in the tub 20 into the drain pump 80, and a drain hose 84 configured to guide water pumped by the drain pump 80 to the outside of the cabinet 10 are provided under the tub 20. Further, the drain pump 80 may drain condensate water generated from the condensing duct 100 which will be described below, and it will be described below in detail Meanwhile, a control panel and a printed circuit board assembly (not shown) are provided on the front surface of the cabinet 10 so that a user may control an operation of the laundry drying machine 1.

A drying apparatus 100 configured to dry air in the tub 20 and supply the air into the tub again is mounted on a rear portion of the tub 20. In detail, the drying apparatus 100 may suction air in the drum 30 through the tub 20, and then may supply the suctioned air to the drum 30 through the tub 20 after condensing and drying the suctioned air.

Hereinafter, the drying apparatus 100 will be described in detail.

FIG. 3 is a rear perspective view of some components of the laundry drying machine according to one embodiment of the present invention, FIG. 4 is a rear perspective view of a condensing duct of the laundry drying machine according to one embodiment of the present invention, and FIG. 5 is an enlarged view illustrating a part of another side of the condensing duct in FIG. 4.

As shown in FIGS. 2 and 3, the drying apparatus 100 includes a condensing duct 200 configured to condense moisture in the air introduced into the drum 30 through the tub 20, a drying duct 300 configured to heat and dry the air introduced from the condensing duct 200, and a blowing fan 400 disposed between the condensing duct 200 and the drying duct 300 to form a flow of the air so that the air introduced into the condensing duct 200 may be introduced into the tub 20 through the drying duct 300. A heater 310 configured to heat the air in the drying duct 300 may be included in the drying duct 300.

A conventional drying apparatus dries an object to be dried in a drum with a method of circulating air in the drum by condensing the air, introduced into a condensing duct from the drum, with condensate water, and then heating the air in the drying duct and supplying the heated air to the drum again.

In the circulation type drying apparatus, the air supplied to the drum is introduced into the condensing duct by absorbing moisture in the object to be dried, and since the efficiency with which the condensing duct condenses the humid air generated from the drum is poor, the humid air is continuously circulated and thus a problem of drying efficiency reduction occurs.

To solve this problem, the drying apparatus 100 according to one embodiment of the present invention may be provided to be capable of discharging some of the circulated humid air to the outside of the drying apparatus 100, and receiving from the outside and supplying to the drum 30 as much air as that discharged.

By discharging some of the humid air circulated in the drum 30 and supplying external air which is not humid into the drum 30 to reduce the amount of moisture in the air supplied into the drum 30 for drying, an object to be dried may be efficiently dried.

To efficiently dry the object to be dried, since a first path 210 configured to introduce some of the humid air into the drum 30 again, and a second path 220 provided to discharge the remaining humid air to the outside of the drying apparatus 100 are provided separately from each other in the condensing duct 200 into which the humid air is introduced, some of the humid air may be discharged.

That is, some of the air discharged from the drum 30 may be supplied to the drum 30 again through the first path 210, and the remaining air may be discharged to the outside of the drying apparatus 100 through the second path 220.

Further, since an introduction port 410 into which the external air is introduced, and an introduction path 420 configured to introduce the introduced air into the drying duct 300 are provided between the first path 210 and the drying duct 300 through which the air supplied to the drum 30 is circulated, the humid air which is circulated and the external air introduced from the outside may be mixed and supplied to the drum 30.

In detail, one end of the condensing duct 200 may communicate with one side of the rear portion 21 of the tub 20, and the other end of the condensing duct 200 may communicate with a blowing fan housing 430 including the blowing fan 400. Further, one side of the condensing duct 200 may be connected to an auxiliary condensing duct 250 configured to connect a discharge port 260 with the condensing duct 200 to discharge some of the air introduced into the condensing duct 200.

The condensing duct 200 may be formed in a pipe shape including a hollow. The air introduced from the tub 20 may be moved to the drying duct 300 or to the auxiliary condensing duct 250 through the hollow of the condensing duct 200, and may be discharged to the outside of the drying apparatus 100 through the discharge port 260.

As described above, a divider 230 configured to divide a path may be disposed in the hollow of the condensing duct 200 so that the air may flow in two directions. The divider 230 may be provided in a plate shape extending in the hollow in a direction in which the condensing duct 200 extends.

A space in the hollow is divided into two spaces by the divider 230, and the first path 210 and the second path 220 may each be provided in the spaces in the hollow divided by the divider 230.

As shown in FIG. 2, one end of the first path 210 may be provided to communicate with the tub 20, and the other end of the first path 210 may be provided to communicate with the blowing fan 400. The air introduced into the first path 210 may be supplied to the tub 20 again after being blown to the drying duct 300, which is configured to communicate with the blowing fan 400, by the blowing fan 400 and heated.

Since the first path 210 and the second path 220 are divided by the divider 230, the first path 210 communicates with the tub 20, the blowing fan 400, and the drying duct 300, and does not communicate with the auxiliary condensing duct 250 connected to the discharge port 260.

Accordingly, the air introduced into the first path 210 may be circulated and supplied to the tub 20 again and not be discharged to the outside of the cabinet 10, and may finally be introduced into the drum 30 to dry the object to be dried.

As shown in FIGS. 3 and 4, the second path 220 may be separated from the blowing fan 400 and the drying duct 300, (see FIG. 6), and one side thereof may be provided to communicate with the auxiliary condensing duct 250. The auxiliary condensing duct 250 may include one side configured to communicate with the second path 220 of the condensing duct 200, and another side including the discharge port 260.

Further, an additional auxiliary discharge port 260' may be disposed at the other side of the auxiliary condensing duct 250, and may smoothly discharge air by directly discharging the air introduced into the second path 220 to the outside of the cabinet 10.

However, the auxiliary discharge port 260' is a configuration selectively formed according to necessity, not a configuration which must be disposed in the drying apparatus 100.

The air introduced into the second path 220 may be discharged to the discharge port 260 along the auxiliary condensing duct 250 to be discharged to the outside of the drying apparatus 100, and not supplied into the drum 30 again along the drying duct 300.

With respect to a cross-sectional area of the hollow in a direction vertical of the hollow of the condensing duct 200, the divider 230 may partition spaces forming the first path 210 and the second path 220 by dividing the cross-sectional area of the hollow. In this case, the divider 230 may be disposed so that a cross-sectional area of the second path 220 is provided to be greater than or equal to a cross-sectional area of the first path 210.

To increase an amount of the discharged air to be greater than an amount of air which is circulated, the drying apparatus 100 according to one embodiment of the present invention, as described above, includes technical features in which some of the humid air discharged from the drum 30 is discharged to the outside and the external air which will be described below reduces the moisture amount in the air introduced into the drying apparatus 100 and circulated, and since drying efficiency of the drying apparatus 100 is reduced when the amount of the humid air circulated through the first path 210 is large.

Accordingly, in the divider 230, since the cross-sectional area of the second path 220 is disposed to be large, an amount of the air discharged to the outside along the second path 220 may be increased. Preferably, the divider 230 may be disposed to partition so that a cross-sectional area ratio of the first path 210 to the second path 220 is 2:8.

An amount of the air circulated in the drum 30 may be steadily maintained because an amount of external air which is equal to the amount of the air discharged through the second path 220 may be introduced into the drying apparatus 100 through the introduction port 410, and a structure in which the external air is introduced will be described below in detail.

The amount of the discharged air increases as the cross-sectional area of the second path 220 increases, and accordingly, since an amount of the air introduced from the outside increases and the moisture amount in the circulated air is reduced, the drying efficiency of the drying apparatus 100 may be improved.

Since the first path 210 and the second path 220 are provided in a space inside the hollow of the condensing duct 200, the first path 210 and the second path 220 may be integrally provided with the condensing duct 200.

Further, since the divider 230 is also provided in the space inside the hollow of the condensing duct 200, the first path 210, the second path 220, and the divider 230 may be integrally formed. The first path 210, the second path 220, and the divider 230 may be integrally injection-molded, and may be integrally formed by various molding methods. However, the first path 210, the second path 220, and the divider 230 are not limited thereto, and may each be variously formed according to a method of forming the condensing duct 200.

That is, when the condensing duct 200 is formed by assembly, the first path 210 and the second path 220 may also be formed by assembly, and the divider 230 may also be provided to be formed by assembly in the condensing duct 200.

The condensing duct 200 may be disposed on the rear portion 21 of the tub 20 to restrict the driving of components such as the shaft 90, the pulley 91, the driving belt 92, and the like disposed on the rear portion 21 of the tub.

To prevent this problem, since the condensing duct 200 is disposed at one side between both lateral sides of the rear portion 21, and the auxiliary condensing duct 250 configured to extend from the condensing duct 200 is disposed at one side between both vertical sides of the rear portion 21, a space in which the pulley 91 may be driven may be secured.

According to one embodiment of the present invention, the condensing duct 200 may be disposed in a shape extending on the right side of the rear portion 21 in a vertical direction, and the auxiliary condensing duct 250 may be disposed in a shape branching from an upper portion of the condensing duct 200 and extending in a lateral direction. Accordingly, the discharge port 260 may be disposed at an upper left side of the rear portion 21.

Hereinafter, the first path 210 and the second path 220 will be described in detail.

FIG. 6 is a perspective view of the condensing duct, of which a part has been removed so that a second path is shown, of the laundry drying machine according to one embodiment of the present invention, FIG. 7 is a cross-sectional view of the part, in which the second path is shown, of the condensing duct of the laundry drying machine according to one embodiment of the present invention, and FIG. 8 is a cross-sectional view of a part, in which a first path is shown, of the condensing duct of the laundry drying machine according to one embodiment of the present invention.

As shown in FIGS. 6 and 7, the second path 220 may be provided so that the air introduced into the second path 220 of condensing duct 200 from the tub 20 may be introduced into the discharge port 260 along the auxiliary condensing duct 250 configured to communicate with the second path 220, and then discharged to the outside of the drying apparatus 100.

The second path 220 may substantially extend not only to the condensing duct 200 but to a section extending to the discharge port 260 along the auxiliary condensing duct 250. Accordingly, the second path 220 may be seen in a strict sense as a path formed by a section partitioned in the condensing duct 200 by the divider 230, and in a broad sense may be seen as a concept including a path in the condensing duct 200 configured to discharge the air from the condensing duct 200 to the discharge port 260, and a path provided in the auxiliary condensing duct 250.

In the auxiliary condensing duct 250 (the condensing duct 200 may be defined as a first condensing duct, and the auxiliary condensing duct 250 may be defined as a second condensing duct), one side thereof may be provided to communicate with one side of the second path 220, and the other side thereof may include the discharge port 260.

As described above, the auxiliary condensing duct 250 may serve to discharge the air introduced into the second path 220 to the discharge port 260, and to discharge the air condensed in the condensing duct 200 to the discharge port 260 after being condensed again with condensate water. A process in which the air is condensed in the condensing duct 200 and the auxiliary condensing duct 250 may be described below in detail.

A filter 270 disposed in the second path 220 may be disposed inside the auxiliary condensing duct 250. Foreign substances such as lint generated from the object to be dried may be included in some of the air introduced from the drum 30, and the filter may be disposed in the second path 220 and collect the foreign substances to prevent discharge of the foreign substances to the outside.

A filter cleaning device 271 configured to clean the foreign substances collected on the filter 270 may be disposed adjacent to the filter 270. The filter cleaning device 271 may receive water and supply a cleaner to the filter 270 to clean the filter 270, and the foreign substances collected on the filter 270 may be removed with cleaning water.

A drain path 280 configured to drain the filter cleaning water and the condensate water which will be described below into the tub 20 may extend downward from the auxiliary condensing duct 250. Since one end of the drain path 280 may be connected to the tub 20, the condensate water and the filter cleaning water left in the auxiliary condensing duct 250 may be drained from the auxiliary condensing duct 250 along the drain path 280. The condensate water and the filter cleaning water introduced into the tub 20 may be drained to the outside of the cabinet 10 by the drain pump 80 with the water left in the tub 20.

The air from which the foreign substances are removed by the filter 270 may be discharged to the outside of the drying apparatus 100 through the discharge port 260, and the foreign substances included in the air may, to be discharged to the outside of the cabinet 10 by the drain pump 80, be collected by the filter 270 and introduced into the tub 20 along the drain path 280 with the cleaner supplied from the filter cleaning device 271.

As shown in FIG. 8, the first path 210 may be provided so that the air introduced from the tub 20 may be supplied into the tub 20 again along the drying duct 300 after being introduced into the blowing fan housing 430 along the first path 210 provided in the condensing duct 200.

That is, the first path 210 may be provided to form a circulation path in a cycle of the drum 30—the tub 20—the condensing duct 200—the first path 210—the blowing fan housing 430—the drying duct 300—the tub 20—the drum 30, without being connected to the discharge port 260 at a center of the path, so that the air discharged from the drum 30 may be circulated and supplied to the drum 30 again.

In the above-described circulation path, the air is circulated by an air pressure difference in the circulation path formed by the driving of the blowing fan 400.

The introduction port 410 into which the external air is introduced may be provided at one side of the blowing fan housing 430. Since some of the air discharged from the drum 30 is discharged outward through the second path 220, when the external air is not introduced, the amount of air circulated into the drum 30 may be reduced.

Accordingly, since the introduction port 410 is provided in the blowing fan housing 430 to secure a predetermined amount of air supplied to the drum 30, an amount of air equal to the amount of air discharged through the second path 240 may be introduced through the introduction port 410, the external air may be mixed with the air circulated through the first path 210 and supplied to the drum 30, and thus the predetermined amount of air may be continuously supplied into the drum 30 while the drying apparatus 100 is driven.

As described above, since the circulated humid air is mixed with the external air, humidity of the air supplied to the drum 30 may be reduced and drying performance of the drying apparatus 100 may be improved.

The air introduced through the introduction port 410 is introduced into the blowing fan housing 430 through the introduction path 420 (see FIG. 2) and mixed with the humid air through the first path 210, and then introduced into the drying duct 300 by the blowing fan 400.

Hereinafter, the process in which the air is condensed in the condensing duct 200 and the auxiliary condensing duct 250, and a process in which the air moves in the condensing duct 200 and the auxiliary condensing duct 250 may be described below in detail.

FIG. 9 is a schematic side-sectional view illustrating a flow of each of air and condensate water in the laundry drying machine according to one embodiment of the present invention, FIG. 10 is a schematic rear-sectional view illustrating a flow of each of the air and the condensate water in the second path of the laundry drying machine according to one embodiment of the present invention, and FIG. 11 is a schematic rear-sectional view illustrating a flow of each of air and condensate water in a second path of a laundry drying machine according to another embodiment of the present invention.

As shown in FIGS. 9 and 10, a condensate water supply device 500 configured to supply the condensate water, which condenses the air introduced into the condensing duct 200, to the second path 220 may be provided at an upper portion of the second path 220.

The condensate water supply device 500 may include a water supply nozzle 501 configured to receive condensate water from the outside, a condensate water container 502 configured to contain the supplied condensate water, and supply holes 503 configured to supply the condensate water contained in the condensate water container 502 to the second path 220.

The condensate water supply device 500 may be provided in the second path 220, and may be disposed at the upper portion of the second path 220 to maximize the amount of time in which the condensate water supplied to the second path 220 through the supply holes 503 comes into contact with the air while falling down.

Protruding ribs 510 configured to diffuse the condensate water, supplied from the supply holes 503, in the second path 220 may be disposed under the condensate water supply device 500 of the second path 220.

The falling condensate water may fall down along the plurality of protruding ribs 510 while being diffused toward both lateral sides of the second path 220. Accordingly, an area in which the condensate water comes into contact with the air which passes through the second path 220 may increase, and thus more air may be condensed.

The protruding ribs 510 may be provided to protrude from one side surface of the divider 230 forming one side of the second path 220. The protruding ribs 510 may be provided to extend obliquely in right and left directions so that the condensate water may fall downward along the oblique directions.

The condensate water which falls downward in the second path 220 along the protruding ribs 510 may be introduced into a lower side of the condensing duct 200, and then may be introduced into a part configured to communicate with the tub 20 and drained to the tub 20.

That is, the condensate water heat-exchanged with air may be collected into the connection pipe, which is configured to connect the tub 20 and the condensing duct 200 to introduce the air in the drum 30 into the condensing duct 200, and then may be introduced into the tub 20. The condensate water introduced into the tub 20 may be drained to the outside of the cabinet 10 through the drain pump 80.

The water supply nozzle 501 may protrude to extend to the outside of the second path 220, and then may be directly connected to the water supply valve 56 or connected to a condensate water supply pipe (not shown) configured to drain condensate water from one side of the water supply pipe 50.

The condensate water supplied from the water supply nozzle 501 may be contained in the condensate water container 502 configured to contain the condensate water, and may be supplied to the second path 220 by a command of a controller (not shown).

A plurality of supply holes 503 may be formed in holes connected to one side of the condensate water container 502. The plurality of supply holes 503 may extend toward a lower side of the second path 220 and supply the condensate water to the lower side of the second path 220 to drop the condensate water into the second path 220.

However, in contrast to one embodiment of the present invention, the condensate water supply device 500 may include not the simple supply holes 503 but a spray configuration which sprays condensate water to the second path 220 in a spraying method to supply the condensate water to the second path 220.

As described above, the condensate water supply device 500 may be disposed in the second path 220. Accordingly, the condensate water is directly heat-exchanged with the air which passes through the second path 220, and not directly heat-exchanged with the air which passes through the first path 210.

Because some of the falling condensate water may be introduced into the drying duct 300 by the blowing fan 400 when the condensate water supply device 500 is provided in the first path 210, the moisture amount in the air circulated to the drum 30 may be increased, and thus the drying efficiency may be reduced.

That is, the air which passes through the first path 210 passes through the first path 210 without heat-exchanging with the condensate water.

However, since the condensate water falls down toward the lower side of the second path 220 along the protruding ribs 510 disposed on the divider 230, a temperature of the divider 230 decreases due to the condensate water which falls along the protruding ribs 510.

Since a surface opposite a surface of the divider 230 from which the protruding ribs 510 protrude forms the first path 210, and a temperature of the opposite surface of the divider 230 may be lowered by a low temperature transferred from the protruding ribs 510, the air which passes through the first path 210 may indirectly undergo heat-exchange to be condensed by coming into contact with the opposite surface of the divider 230.

Accordingly, the air which passes through the first path 210 and the second path 220 may be directly or indirectly condensed by the condensate water to reduce the moisture amount included therein.

An auxiliary condensate water supply device 520 configured to further condense moisture in the air which passes through the second path 220 may be provided in the auxiliary condensing duct 250.

The auxiliary condensate water supply device 520 may include an auxiliary water supply nozzle 521 configured to receive condensate water from the outside, an auxiliary condensate water container 522 configured to contain the supplied condensate water, and auxiliary supply holes 503 configured to supply the condensate water contained in the auxiliary condensate water container 502 to the auxiliary condensing duct 250.

The auxiliary condensate water supply device 520 may be provided in an upper portion of the auxiliary condensing duct 250 and drop the condensate water to maximize the amount of time in which the condensate water supplied to the auxiliary condensing duct 250 through the auxiliary supply holes 503 comes into contact with the air while falling down.

As shown in FIG. 11, in the case of a laundry drying machine according to another embodiment of the present invention, auxiliary protruding ribs 540 configured to diffuse condensate water in an auxiliary condensing duct 250 may be disposed inside the auxiliary condensing duct 250.

The falling condensate water may fall down along the plurality of auxiliary protruding ribs 540 while being diffused toward both lateral sides of the auxiliary condensing duct 250. Accordingly, an area in which the condensate water comes into contact with air which passes through the auxiliary condensing duct 250 may increase, and thus more air may be condensed.

The condensate water which falls down in the auxiliary condensing duct 250 along the auxiliary protruding ribs 540 may be introduced into a lower side of the auxiliary protruding ribs 540, and then may be introduced into a drain path 280, which is configured to communicate with a tub 20, to be drained to the tub 20.

As shown in FIGS. 9 and 10, the air introduced from the tub 20 may be divided into circulated air A1 circulated along the first path 210 and discharged air A2 discharged to the outside along the second path 220.

The air introduced from the tub 20 may be divided into the circulated air A1 and the discharged air A2 by the divider 230 provided in the condensing duct 200.

The circulated air A1 may move upward along the first path 210 and be mixed with external air A3 introduced from the introduction port 410 to form mixed air A4, and then the mixed air A4 may be heated to be supplied into the tub 20 again after being introduced into the drying duct 300 by the blowing fan 400.

Since the discharged air A2 may move upward along the second path 220, a first condensation may be performed when the discharged air A2 is heat-exchanged with the condensate water supplied from the condensate water supply device 500, a second condensation may be performed when the discharged air A2 moves to the auxiliary condensing duct 250 and is heat exchanged with the condensate water supplied from the auxiliary condensate water supply device 520, and then the discharged air A2 may be discharged to the outside of the drying apparatus 10 through the discharge port 260.

Hereinafter, features in which the air discharged from the discharge port 260 is discharged to the outside of the drying apparatus 10 will be described in detail.

FIG. 12 is a rear view of a cabinet according to one embodiment of the present invention, FIG. 13 is a front view of a rear cabinet according to one embodiment of the present invention, and FIG. 14 is a schematic side-sectional view illustrating a flow of each of air discharged from and external air introduced into the laundry drying machine according to one embodiment of the present invention.

As shown in FIGS. 12 and 13, an introduction fan 600 configured to introduce the external air into the cabinet 10 may be disposed in a rear cabinet 10*a*. The introduction fan 600 may be disposed adjacent to the discharge port 260 so that the air discharged from the discharge port 260 and the external air may be mixed.

However, the above is not limited to one embodiment of the present invention, and the introduction fan 600 may be disposed in a configuration excluding the rear cabinet 10*a*. That is, the introduction fan 600 may be seated in the configuration which excludes the rear cabinet 10*a* and extends from the cabinet 10 to be disposed adjacent to the discharge port 260, and may be seated to be disposed in a configuration extending from the discharge port 260.

Although the humid air discharged through the discharge port 260 is condensed while passing through the condensing duct 200 and the auxiliary condensing duct 250 due to the heat-exchange with the condensate water, not all the moisture in the humid air is condensed, and thus some of the humid air may be discharged through the discharge port 260.

The air discharged through the discharge port 260 may be discharged to the outside of the cabinet 10 through a plurality of slits 18 having the form of openings provided in the rear cabinet 10*a* after being discharged into the cabinet 10 first, and dew condensation may occur in the cabinet 10 due to some of the humid air continuously being discharged from the discharge port 260.

When moisture is formed in the cabinet 10 due to the dew condensation, since the moisture is introduced to an electrical component (not shown) electrically connected to and disposed inside the cabinet 10, reliability of the driving of the laundry drying machine may be lowered.

To prevent the dew condensation, the introduction fan 600 configured to introduce the external air may be provided adjacent to the discharge port 260, and the discharged air may be mixed with the external air to reduce the moisture amount included therein.

An introduction port grill 16 configured to cover the introduction port 410 may be disposed at a side corresponding to the introduction port 410 of the rear cabinet 10*a* to prevent introduction of foreign substances into the blowing fan 400, and an introduction fan grill 610 may be disposed at a side corresponding to the introduction fan 600 to prevent introduction of the foreign substances into the introduction fan 600.

The plurality of slits 18 having the form of openings may be provided in some spaces of the rear cabinet 10*a* so that the air discharged into the cabinet 10 may be discharged to the outside of the cabinet 10. The size, shape, and locations at which the slits 18 are disposed are not limited to one embodiment of the present invention and may be variously provided.

As shown in FIG. 14, the air discharged from the discharge port 260 may be mixed with external air introduced from the introduction fan 600 to form mixed air of which a moisture amount is low, and may be discharged to the outside of the cabinet 10 along the plurality of slits 18.

In detail, the introduction fan 600 may be provided to introduce the external air into the discharge port 260. Accordingly, since the air which passes through the discharge port 260 may be mixed with the external air, directly after being discharged, to form the mixed air of which the moisture amount is low, formation of moisture in the cabinet 10 due to the dew condensation may be prevented.

Hereinafter, the laundry drying machine according to another embodiment of the present invention will be described. Except for a discharge fan 700, since components according to another embodiment of the present invention are the same as the components of the laundry drying machine and the drying apparatus according to one embodiment of the present invention, repetitive descriptions thereof will be omitted.

FIG. 15 is a schematic side-sectional view illustrating a flow of each of air discharged from and external air introduced into the laundry drying machine according to another embodiment of the present invention.

The discharge fan 700 configured to discharge air to the outside of a cabinet 10 may be disposed adjacent to a discharge port 260.

As described above, since dew condensation may occur in the cabinet 10 due to humid air discharged from the discharge port 260, the discharge fan 700 is disposed to quickly discharge the air discharged from discharge port 260 to the outside of the cabinet 10 to prevent this problem.

Accordingly, the air discharged from the discharge port 260 may be quickly discharged to the outside of the cabinet 10 to prevent the occurrence of dew condensation due to the humid air.

Although a few embodiments of the present invention have been shown and described, it should be appreciated by those skilled in the art that changes may be made to the embodiments without departing from the principles and spirit of the present invention, and the scope of the present invention defined in the claims and their equivalents.

The invention claimed is:

1. A drying apparatus comprising:

a cabinet including an introduction port into which external air is introduced;

a drum disposed inside the cabinet and configured to accommodate an object which is to be dried;

a condensing duct provided to condense moisture in humidified air introduced from the inside of the drum;

a discharge port configured to communicate with the condensing duct to discharge, some of the humidified air introduced from the condensing duct to the outside of the cabinet; and a drying duct connected to the condensing duct, the introduction port, and the drum, wherein external air introduced through the introduction port is provided to the drying duct, and the drying duct is configured to heat the humidified air circulated through the condensing duct and the external air introduced through the introduction port, and to supply the heated air to the drum, wherein the condensing duct includes a first path configured to communicate with the drying duct for introducing some of the humidified air into the drum again, and a second path provided separately from the first path and configured to communicate with the discharge port for discharging a remaining portion of the humidified air to the outside of the drying apparatus, and the introduction port is located between the first path and the drying duct.

2. The drying apparatus of claim 1, wherein the condensing duct further includes a divider disposed between the first path and the second path to divide the first path and the second path.

3. The drying apparatus of claim 2, wherein:

the condensing duct is provided in a pipe shape including a hollow; and the first path and the second path each are provided in spaces in the hollow divided by the divider.

4. The drying apparatus of claim 3, wherein, in a cross-sectional area of each of the first path and the second path through which the air passes, the divider divides the first path and the second path so that the cross-sectional area of the second path is provided to be greater than or equal to the cross-sectional area of the first path.

5. The drying apparatus of claim 4, wherein a cross-sectional area ratio of the cross-sectional area of the first path to the cross-sectional area of the second path is 2:8.

6. The drying apparatus of claim 1, further comprising an auxiliary condensing duct configured to connect the condensing duct and the discharge port to guide the air introduced into the discharge port from the condensing duct, and condense the residual moisture in the air introduced from the condensing duct.

7. The drying apparatus of claim 1, further comprising a blowing fan disposed between the first path and the drying duct to circulate the humidified air in the first path and the drying duct, and configured to introduce the external air introduced through the introduction port into the drying duct.

8. The drying apparatus of claim 1, wherein the condensing duct further includes a condensate water supply device configured to introduce condensate water into the condensing duct to condense the humidified air which passes through the condensing duct, when the condensate water comes into contact with air passing through the condensing duct, wherein the condensate water supply device is disposed at an upper portion of the second path.

9. The drying apparatus of claim 8, wherein the condensate water is not supplied into the first path.

10. The drying apparatus of claim 8, wherein a plurality of protruding ribs configured to protrude toward the inside of the second path, are provided in the second path so that the condensate water is diffused.

11. The drying apparatus of claim 6, wherein the auxiliary condensing duct includes an auxiliary condensate water supply device configured to introduce the condensate water into the auxiliary condensing duct to condense the humidified air which passes through the auxiliary condensing duct.

12. The drying apparatus of claim 1, further comprising an introduction fan disposed adjacent to the discharge port to introduce the external air into the discharge port so that the air which passes through the discharge port is mixed with the external air in the cabinet.

13. The drying apparatus of claim 1, further comprising a discharge fan disposed adjacent to the discharge port to quickly discharge the air which passes through the discharge port to the outside of the cabinet.

14. The drying apparatus of claim 12, wherein the introduction fan is disposed in a rear surface of the cabinet.

* * * * *